United States Patent [19]

Eliasson et al.

[11] Patent Number: 4,983,881

[45] Date of Patent: Jan. 8, 1991

[54] HIGH-POWER RADIATION SOURCE

[75] Inventors: Baldur Eliasson, Birmenstorf; Ulrich Kogelschatz, Hausen, both of Switzerland

[73] Assignee: Asea Brown Boveri Ltd., Baden, Switzerland

[21] Appl. No.: 295,743

[22] Filed: Jan. 11, 1989

[30] Foreign Application Priority Data

Jan. 15, 1988 [CH] Switzerland ..... 00152/88

[51] Int. Cl.[5] ..... H01J 17/06; H01J 61/06; H01J 61/42

[52] U.S. Cl. ..... 313/607; 313/489; 313/493; 313/234; 313/635

[58] Field of Search ..... 313/607, 489, 485, 493, 313/634, 635, 234; 315/248, 358

[56] References Cited

U.S. PATENT DOCUMENTS

| | | | |
|---|---|---|---|
| 4,266,167 | 5/1981 | Proud et al. | 315/248 |
| 4,778,581 | 10/1988 | Sigai | 313/489 X |
| 4,837,484 | 6/1989 | Eliasson et al. | 313/607 X |
| 4,851,734 | 7/1989 | Hamai et al. | 313/607 X |

FOREIGN PATENT DOCUMENTS 739064 3/1970 Belgium .

OTHER PUBLICATIONS

Journal of Applied Spectroscopy, vol. 41, No. 4, Oct. 1984, Plenum Publishing Corp. New York, NY G. A. Volkova, et al.

*Primary Examiner*—Kenneth Wieder

*Attorney, Agent, or Firm*—Oblon, Spivak, McClelland, Maier & Neustadt

[57] ABSTRACT

The high-power radiation source for visible light includes a discharge space (4) bounded by dielectrics (1, 10) and filled with a noble gas or gas mixture. Adjacent to the dielectrics (1,10) are luminescent coatings (5,11). Both the dielectric (1,10) and the electrode (6,12) situated on the surfaces of the dielectrics facing away from the discharge space (4) are transparent to the radiation generated by the dark electrical discharges. In this way, a large-area radiation source with high efficiency is provided which can be operated with high electrical power densities of up to 50 kW/m$^2$ of active electrode surface.

36 Claims, 2 Drawing Sheets

HIGH-POWER RADIATION SOURCE

BACKGROUND OF THE INVENTION

1. Field of the Invention

The invention relates to a high-power radiation source having a discharge space filled with a filling gas which forms excimers under discharge conditions. One wall of which is formed by a first dielectric the discharge space is provided with a first electrode on its surface facing away from the discharge space. At least the first electrode and/or the first dielectric is transparent to radiation. An alternating power source is connected to the first and second electrodes to feed the discharge.

2. Discussion of Background

In this connection, the invention relates to a prior art, such as emerges, for example, from the lecture by U. Kogelschatz entitled "Neue UV- und VUV-Excimerstrahler" ("New UV and VUV Excimer Radiation Sources") delivered at the tenth Lecture Conference of the Gesellschaft Deutscher Chemiker, specialist group for photochemistry, in Würzburg on Nov. 18–20 1987.

The V high-power radiation source presented at that lecture conference is described in detail as the technological background and prior art in the European Patent Application No. 87,109,674.9 of 6.7.1.87, the Swiss Application No. 2924/86-8 of 22.7.1986, and the U.S. Application No. 07/076,926 of 22.7.1987. That high-power radiation source can be operated with high electrical power densities and high efficiency. Its geometry can be matched within wide limits to the process in which it is used. Thus, in addition to large-area, flat radiation sources, cylindrical radiation sources which radiate inwards or outwards are also possible. The discharges can be operated at high pressure (0.1–10 bar). With this construction, electrical power densities of 1–50 $kW/m^2$ can be achieved. Since the electron energy in the discharge can be optimized to a large extent, the efficiency of such radiation sources is very high, even if resonance lines of suitable atoms are excited. The wavelength of the radiation can be adjusted by the type of filling gas for example, mercury (185 nm, 254 nm), nitrogen (337–415 nm, selenium (196, 204, 206 nm), arsenic (189,.193 nm), iodine (183 nm), xenon (119, 130, 147 nm), and krypton (142 nm). As in the case of other gas discharges, mixing various types of gas is also recommended.

The advantage of these radiation sources is the two-dimensional emission of high radiation powers with high efficiency. Almost the entire radiation is concentrated on one or a few wavelength ranges. In all cases it is important that the radiation can emerge through one of the electrodes. This problem can be solved with transparent, electrically conducting coatings or, alternatively, also by using a fine-mesh wire gauze or deposited conductor tracks as electrode, which, on the one hand, ensure the supply of current to the dielectric but which, on the other hand, are largely transparent to the radiation. It is also possible to use a transparent electrolyte, for example $H_2O$, as a further electrode. This is advantageous, in particular, for the irradiation of water/waste water since, in this way, the radiation produced is fed directly into the liquid to be irradiated and the liquid serves at the same time as coolant.

OBJECT OF THE INVENTION

Accordingly, one object of this invention is to modify the high-power radiation source of this class so that it emits preferably light in the wavelength range of 400 nm–800 nm-i.e. in the visible light range.

SUMMARY OF THE INVENTION

This object is achieved by a radiation source wherein the dielectric is provided with a luminescent coating.

The invention is based on the same discharge geometry as that of the UV high-power radiation source described in the above referenced patent applications.

The UV photons produced by excimer radiation in the discharge space cause the coating to fluoresce or phosphorence when they impinge on it and consequently produce visible radiation. With modern phosphors, this process of conversion into visible light can be very efficient (quantum yield up to 95%). The coating is advantageously deposited on the inside of the dielectric because, as a result of this, the dielectric itself can be composed only of normal glass. All the difficulties which are encountered in connection with a UV source embodying UV-transparent materials do not then occur. The luminescent coating may have to be protected with a thin UV-transparent coating against the attack of the discharge.

The required UV wavelength can be selected by means of the gas filling. Excimers, for example, (noble gases, mixtures of noble gases and halogens, mercury, cadmium or zinc) or mixtures of metals with strong resonance lines (mercury, selenium etc.) in very small quantities and of noble gases are suitable as radiating molecules, the mercury-free filling gases being preferable since these do not result in any waste-disposal problems. In this way, for example, a mercury radiation source can be constructed with similar properties to those which form the basis of the conventional fluorescent tube and the new gas discharge lamps.

BRIEF DESCRIPTION OF THE DRAWINGS

A more complete appreciation of the invention and many of the attendant advantages thereof will readily be obtained as the same becomes better understood by reference to the following detailed description when considered in connection with the accompanying drawings, wherein.

DESCRIPTION OF THE PREFERRED EMBODIMENTS

Figure 1:
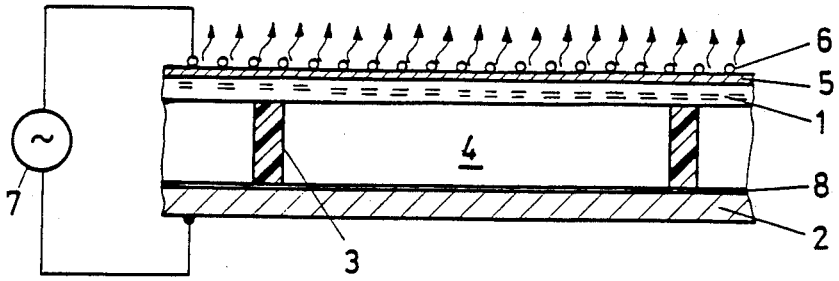
FIG. 1 shows a section of an exemplary embodiment of the invention in the form of a flat panel-type radiation source emitting on one side.

Referring now to the drawings, wherein like reference numerals designate identical or corresponding parts throughout the several views, the panel-type high-power radiation source shown in FIG. 1 essentially comprises a quartz or sapphire panel 1 and a metal panel 2 which are separated from each other by spacers 3 of insulating material. The panels 1 and 2 form the boundaries of a discharge space 4 having a typical gap width of between 1 and 10 mm. The outer surface of the quartz or sapphire panel 1 is covered with a luminescent coating 5, adjacent to which is a relatively wide-mesh wire gauze 6 of which only the warp or weft filaments are visible. The wire gauze 6 and the metal panel 2 form the two electrodes of the radiation source.

The electrical power is supplied by an alternating power source 7 connected to these electrodes. As power source it is, in general, possible to make use of those which have long been used in conjunction with ozone generators.

The discharge space 4 is closed laterally in the normal manner. It is evacuated before sealing and is filled with an inner gas or a substance (for example, mercury, noble gas, noble gas/metal vapor mixture, noble gas/halogen mixture) which forms excimers under discharge conditions, optionally with an additional further noble gas (Ar, He, Ne) being used as buffer gas.

In this connection, depending on the required spectral composition of the radiation and luminescent coating, it is possible to use, for example, a substance according to the table below:

| FILLING GAS | RADIATION |
|---|---|
| Helium | 60–100 nm |
| Neon | 80–90 nm |
| Argon | 107–165 nm |
| Xenon | 160–190 nm |
| Nitrogen | 337–415 nm |
| Krypton | 124 nm, 140–160 nm |
| Krypton + fluorine | 240–255 nm |
| Mercury + argon | 235 nm |
| Deuterium | 150–250 nm |
| Xenon + fluorine | 400–550 nm |
| Xenon + chlorine | 300–320 nm |
| Xenon + iodine | 240–260 nm |

In addition to the above gases or gas mixtures, noble gas/metal mixtures are suitable, metals with strong resonance lines being preferred:

| | |
|---|---|
| Zinc | 213 nm |
| Cadmium | 228.8 nm |
| Mercury | 185 nm, 254 nm |

In this connection, for the resonance line radiation sources, the quantity of metal in the gas mixture referred to the quantity of noble gas is very small so that as little self-absorption as possible occurs. As a standard for the upper limit, use may be made, in this connection, of the following relationship:

$$d \times P_M \leqq 10 \text{ torr.mm}$$

where d is the gap width of the discharge space in millimeters (typically 1–10 mm) and $P_M$ is the vapor pressure of the metal.

The upper limit for the metal vapor is formed by the formation of excimers, such as HgXe, HgAr, HgKr for which even 1–20 torr of Hg in, for example, 300 torr of noble gas is sufficient. The excimers radiate at 140–220 nm and are also very efficient UV radiation sources. At higher mercury pressure, the $Hg_2$ excimer is formed which radiates at 235 nm.

The lower limit is about $10^{-2}$ torr.mm.

In the dark discharge (dielectric barrier discharge) which forms, the electron energy distribution can be ideally adjusted by varying the gap width of the discharge space, pressure, and/or temperature.

For very short-wave radiations, panel materials (such as, for example, magnesium fluoride and calcium fluoride) are also suitable. A transparent, electrically conducting coating may also be provided instead of a wire gauze, it being possible to use a coating of indium oxide or tin oxide for visible light and a gold coating 50–100 angstroms thick for visible and UV light.

The luminescent coating 5 is preferably composed of modern phosphors (i.e.) phosphor doped with rare earths), which make possible a quantum yield of up to 95% (cf. E. Kauer and E. Schnedler "Mglichkeiten und Grenzen der Lichterzeugung" ("Possibilities and limits of light generation") in Phys. Bl. 42 (1986), No. 5, pages 128–133, in particular page 132).

In order to virtually double the usable radiation, the metal electrode 2 may itself be composed of UV-reflecting material (for example, aluminum) or be provided with a UV-reflecting coating 8.

Figure 2:
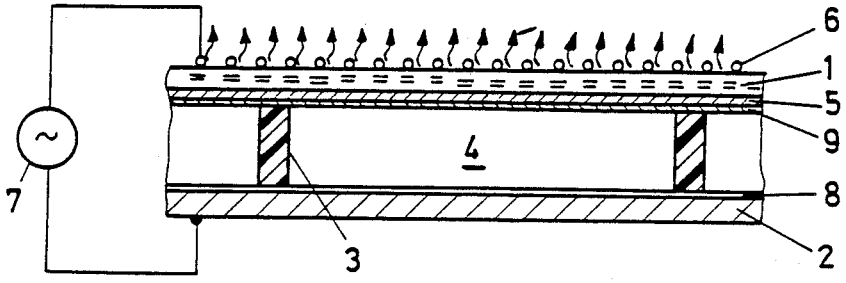
FIG. 2 shows a section of an exemplary embodiment as shown in FIG. 1 with luminescent coating situated on the inside.

The embodiment shown in FIG. 2 differs from that shown in FIG. 1 ony in the layer sequence. The luminescent coating 5 is on the surface of the panel 1 facing the discharge space 4 and is preferably protected by a protective coating 9 against attack by the discharge. It must be UV-transparent and is composed, for example, of magnesium fluoride ($MgF_2$) or $Al_2O_3$. Coatings of this type are deposited in known manner by means of "sputtering" (ion dispersion). Because the UV-visible light conversion takes place in this embodiment before passing through the dielectric (panel 1), the panel 1 may be composed of a "normal" light-transparent material—for example, glass.

Figure 3:
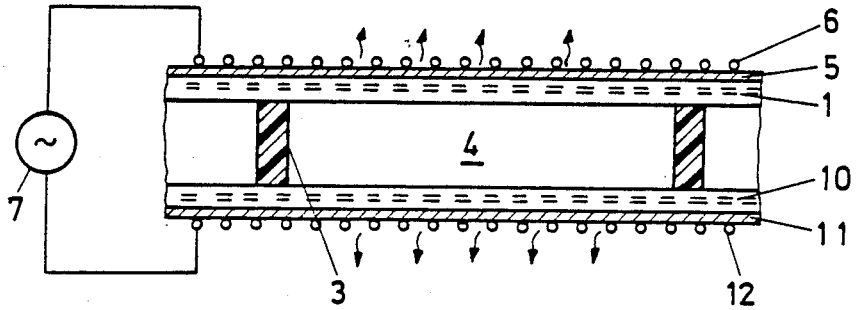
FIG. 3 shows a section of an exemplary embodiment of the invention in the form of a flat panel-type radiation source emitting on two sides.
Figure 4:
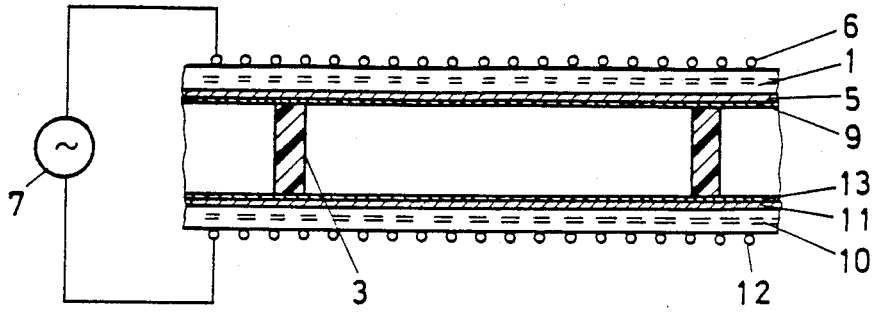
FIG. 4 shows a section of a modification of the exemplary embodiment shown in FIG. 3 with luminescent coatings situated on the inside.

The high-power radiation source shown in FIG. 3 emits visible light on both sides. The discharge space 4 is bounded on both sides by panels 1, 10 of UV-transparent material, for example quartz glass or sapphire glass. Both outer surfaces are covered with a luminescent coating 5 or 11 respectively. The electrodes are formed by wire gauzes 6 or 12, respectively each of which is connected to the alternating power source 7. Analogously to the embodiments shown in FIGS. 1 and 2, the wire gauzes 6, 12 can also be replaced by transparent, electrically conducting coatings (for example, of indium oxide or tin oxide) and a gold layer 50–100 angströms thick for visable and UV light. As shown in FIG. 4, analogously to FIG. 2, there is again the possibility in this case of depositing the luminescent coatings 5 and 11 on the surfaces of the dielectric panels 1, 10 facing the discharge space 4 and protecting them against attack by the discharge with a protective coating 9 or 13 respectively of $MgF_2$ or $Al_2O_3$. As in FIG. 2, the dielectric (i.e., the panels 1, 10) can in this case again be composed of glass.

Figure 5:
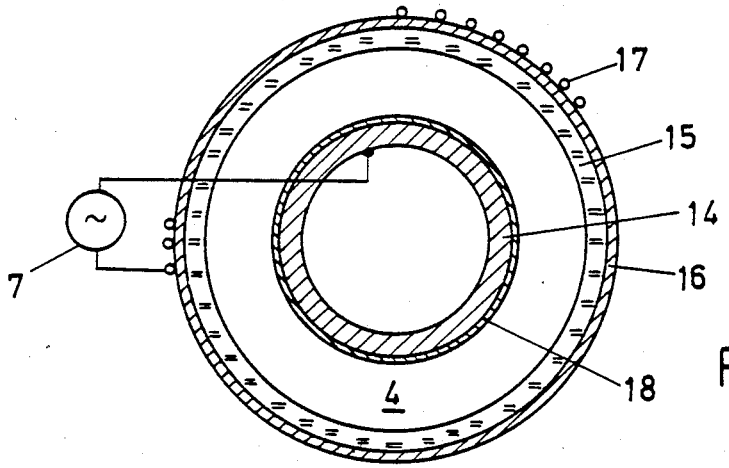
FIG. 5 shows an exemplary embodiment of a cylindrical radiation source emitting outwards.

FIG. 5 shows a cylindrical high-power radiation source diagrammatically in cross-section. A metal tube 14 (inner electrode) is surrounded concentrically by a dielectric tube 15 at a distance (1–10 mm); the outer surface of the dielectric tube 15 is provided with a luminescent coating 16. Adjacent to the luminescent coating 16 is an outer electrode in the form of a wire gauze 17. The alternating power source 7 is connected to the two electrodes 14, 17. The metal tube 14 is composed of aluminum or is provided with an aluminum coating 18 which reflects UV light.

Figure 6:
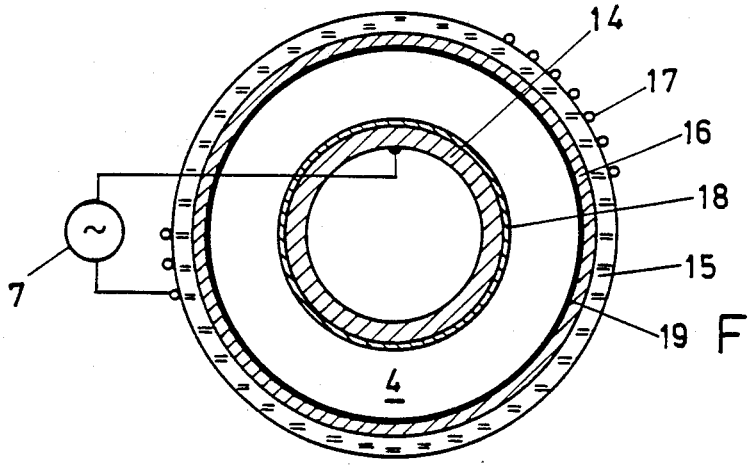
FIG. 6 shows a modification of the exemplary embodiment shown in FIG. 5 with luminescent coating situated on the inside.

In the exemplary embodiment shown in FIG. 6, the luminescent coating 16 is provided on the inside wall of the dielectric tube 15 and is covered in the direction of the discharge space 4 with a protective coating 19 of $MgF_2$ or $AL_2O_3$.

If necessary, a coolant can be passed through the interior of the metal tube 14. Type and composition of filling gas and luminescent coating correspond to those of the preceding exemplary embodiments.

The invention is suitable, in particular, for generating visible light. Depending on the composition of the filling gas and/or the luminescent coating, it is also possible, however, to convert UV radiation of one wavelength into UV radiation of another wavelength.

Obviously numerous modifications and variations of the present invention are possible in the light of the above teachings. It is therefore to be understood that, within the scope of the appended claims, the invention may be practiced otherwise than as specifically described herein.

What is claimed as new and desired to be secured by Letters Patent of the U.S. is:

1. A high-power radiation source comprising:

(a) a first dielectric having a first side and a second side;

(b) a first electrode located on the first side of said first dielectric;

(c) a second electrode located on the second side of said first dielectric;

(d) a discharge space located between said first dielectric and said second electrode;

(e) a filling gas which forms excimers under silent electric discharge conditions filling said discharge space and emitting ultra-violet radiation;

(f) an alternating power source connected to said first and second electrodes;

(g) a first luminescent coating located on said first dielectric;

(h) a second dielectric located between said second electrode and said discharge space; and (i) a second luminescent coating located on said second dielectric, (j) wherein said first and second luminescent coatings are respectively located on the surfaces of said first and second dielectrics remote from said discharge space.

2. A high-power radiation source as recited in claim 1 wherein said first electrode is transparent to radiation.

3. A high-power radiation source as recited in claim 2 wherein said first dielectric is transparent to radiation.

4. A high-power radiation source as recited in claim 1 wherein said first dielectric is transparent to radiation.

5. A high-power radiation source as recited in claim 1 wherein each of said first and second luminescent coatings is protected by a protective coating against attack by discharge.

6. A high-power radiation source as recited in claim 1 wherein said first luminescent coating is located on the surface of said first dielectric adjacent said discharge space.

7. A high-power radiation source as recited in claim 6 wherein said first luminescent coating is protected by a protective coating against attack by discharge.

8. A high-power radiation source as recited in claim 1, wherein said first electrode is made of wire gauze.

9. A high-power radiation source as recited in claim 8 wherein said second electrode is made of wire gauze.

10. A high-power radiation source as recited in claim 1 wherein said second electrode is made of wire gauze.

11. A high-power radiation source as recited in claim 1 wherein said first electrode is made of an electrically conducting, radiation-transparent coating.

12. A high-power radiation source as recited in claim 11 wherein said second electrode is made of an electrically conducting, radiation-transparent coating.

13. A high-power radiation source as recited in claim 1 wherein said second electrode is made of an electrically conducting, radiation-transparent coating.

14. A high-power radiation source as recited in claim 1 wherein said filling gas is selected from the group consisting of mercury, nitrogen, selenium, deuterium, and mixtures of those gases alone or with a noble gas.

15. A high-power radiation source as recited in claim 14 wherein said filling gas contains admixtures of sulphur, zinc, arsenic, selenium, cadmium, iodine, or mercury.

16. A high-power radiation source as recited in claim 1 wherein said first dielectric and said second electrode are of panel-type construction.

17. A high-power radiation source as recited in claim 1 wherein said first dielectric and said second electrode are of tubular construction.

18. A high-power radiation source comprising:

(a) a first dielectric having a first side and a second side;

(b) a first electrode located on the first side of said first dielectric;

(c) a second electrode located on the second side of said first dielectric;

(d) a discharge space located between said first dielectric and said second electrode;

(e) a filling space which forms excimers under silent electric discharge conditions filling said discharge space and emitting ultra-violet radiation;

(f) an alternating power source connected to said first and second electrodes; and (g) a first luminescent coating located on said first dielectric, (h) wherein said first luminescent coating is located on the surfaces of said first dielectric remote from said discharge space.

19. A high-power radiation source as recited in claim 18 and further comprising:

(a) a second dielectric located between said second electrode and said discharge space and (b) a second luminescent coating located on said second dielectric.

20. A high-power radiation source as recited in claim 19 wherein said first and second luminescent coatings are respectively located on the surfaces of said first and second dielectrics adjacent said discharge space.

21. A high-power radiation source s recited in claim 18 wherein said first electrode is transparent to radiation.

22. A high-power radiation source as recited in claim 21 wherein said first dielectric is transparent to radiation.

23. A high-power radiation source as recited in claim 18 wherein said first dielectric is transparent to radiation.

24. A high-power radiation source as recited in claim 20 wherein each of said first and second luminescent coating are protected by a protective coating against attack by discharge.

25. A high-power radiation source as recited in claim 18 wherein said luminescent coating is located on the surface of said first dielectric adjacent said discharge space.

26. A high-power radiation source as recited in claim 25 wherein each of said first luminescent coating is protected by a protective coating against attack by discharge.

27. A high-power radiation source as recited in claim 18 wherein said first dielectric is made of wire gauze.

28. A high-power radiation source as recited in claim 19 wherein said second dielectric is made of wire gauze.

29. A high-power radiation source s recited in claim 18 wherein said second electrode is made of wire gauze.

30. A high-power radiation source as recited in claim 18 wherein said first electrode is made of an electrically conducting, radiation-transparent coating.

31. A high-power radiation source as recited in claim 30 wherein said second electrode is made of an electrically conducting, radiation-transparent coating.

32. A high-power radiation source as recited in claim 18 wherein said second electrode is made of an electrically conducting, radiation-transparent coating.

33. A high-power radiation source as recited in claim 18 wherein said filling gas is selected from the group consisting of mercury, nitrogen, selenium, deuterium, and mixtures of those gases alone or with a noble gas.

34. A high-power radiation source as recited in claim 33 wherein said filling gas contains admixtures of sulfur, zinc, arsenic, selenium, cadmium, iodine, or mercury.

35. A high-power radiation source as recited in claim 18 wherein said first dielectric and said second electrode are of panel-type construction.

36. A high-power radiation source as recited in claim 18 wherein said first dielectric and said second electrode are of tubular construction.

* * * * *